US005205014A

United States Patent [19]

Yoo

[11] Patent Number: 5,205,014

[45] Date of Patent: Apr. 27, 1993

[54] VACUUM CLEANER HAVING A LIQUID MEDIUM FILTER

[75] Inventor: Byoung H. Yoo, Daejun, Rep. of Korea

[73] Assignee: Yong Won Kang, Seoul, Rep. of Korea

[21] Appl. No.: 667,503

[22] Filed: Mar. 11, 1991

[51] Int. Cl.[5] ..... A47L 9/18

[52] U.S. Cl. ..... 15/353; 55/216; 55/250; 55/472

[58] Field of Search ..... 15/353, 319; 55/213, 55/216, 250, 259, 472

[56] References Cited

U.S. PATENT DOCUMENTS

| | | | |
|---|---|---|---|
| 1,838,512 | 12/1931 | Wilson | 55/259 X |
| 2,406,278 | 8/1946 | Worth | 55/250 X |
| 2,468,934 | 5/1949 | Kleyn | 55/472 X |
| 2,527,439 | 10/1950 | McGuire | 55/250 |
| 2,673,619 | 3/1954 | Martin | 15/353 X |
| 3,173,164 | 3/1965 | Congdon | 55/216 X |
| 3,180,071 | 4/1965 | Nolte | 55/213 |
| 3,286,444 | 11/1966 | Boswinkle et al. | 55/259 X |
| 3,748,834 | 7/1973 | Ruby | 55/213 |
| 4,776,060 | 10/1988 | Chang | 15/353 X |

*Primary Examiner*—Chris K. Moore
*Attorney, Agent, or Firm*—Fiddler Levine & Mandelbaum

[57] ABSTRACT

A vacuum cleaner has wet and dry modes. In dry mode, air containing dust is passed through a multi-stage filter including adjacent subchambers containing a liquid for removing microscopic dust from the incoming air. The liquid is prevented from being exhausted from the vacuum cleaner with the exhausted air and is returned to the subchambers. In wet mode, a float and float guide cause a difference in pressure when the vacuum cleaner is filled with liquid. The pressure difference is sensed to actuate an electric circuit breaker to prevent overflow.

4 Claims, 6 Drawing Sheets

VACUUM CLEANER HAVING A LIQUID MEDIUM FILTER

The present invention relates to a vacuum cleaner particularly to a no filter type liquid filtering vacuum cleaner employing liquid as a filter medium, having water sweeper means with an automatic power break function actuated by a pressure sensor when excess water has been sucked in.

BACKGROUND OF THE INVENTION

In a number of conventional vacuum cleaners the air in the cleaner casing is discharged by a moter fan, so that the pressure in the casing is lower than atmospheric pressure. A high speed air stream is formed by this air pressure differential, causing the corrupt air including dust to be inhaled through a dust in-let plate and flexible hose with an air suction hole, and passed to a filter unit with a solid filter of paper or cloth. This solid filter system has many problems, and has to be cleaned or have the filter changed after use.

As the fine pores of the air filter are clogged by dust, the intake air power of the machine declines rapidly. Most of the large particles of dust are intercepted by the filter but micro particles are passed through the filter with the air and returned to diffuse back into the room.

Thus, the room air becomes more turbid and harmful to the health.

Also the conventional solid filter system, is by nature such that there is a tradeoff between air in-let force and filter rate.

That is, filter rate is lower when the filter is coarse for achieving a higher air inlet force. The air in-let force is lower when the filter is dense for achieving a higher filter rate.

SUMMARY OF THE INVENTION

It is an object of the present invention to provide an electric vacuum cleaner which employs a liquid filter medium, multi-stage filtering chamber and electric power breaker means utilizing a pressure sensor to detect the pressure difference caused by the float acting, from the rising of water level, to closed up of the overflow hole, when excess water is sucked in.

A filterless type, liquid filtering vacuum cleaner according to the present invention comprises a multiple filter, employing liquid as a filter medium. Liquid overflow is controlled in accordance with partial pressure differential and flow rate change according to Bernouli's theorem. An automatic electric break means in response to a pressure sensor which is operated by a float and float guide when operating as a water sweeper means.

Additional objects and features of the present invention will be apparent from the following description in which reference is made to the accompanying drawings.

In the drawings:

FIG. 6(*b*) is a sectional view showing the open state (switch off) of the switch of FIG. 6(*a*);

DETAILED DESCRIPTION OF THE PREFERRED EMBODIMENT

Figure 1:
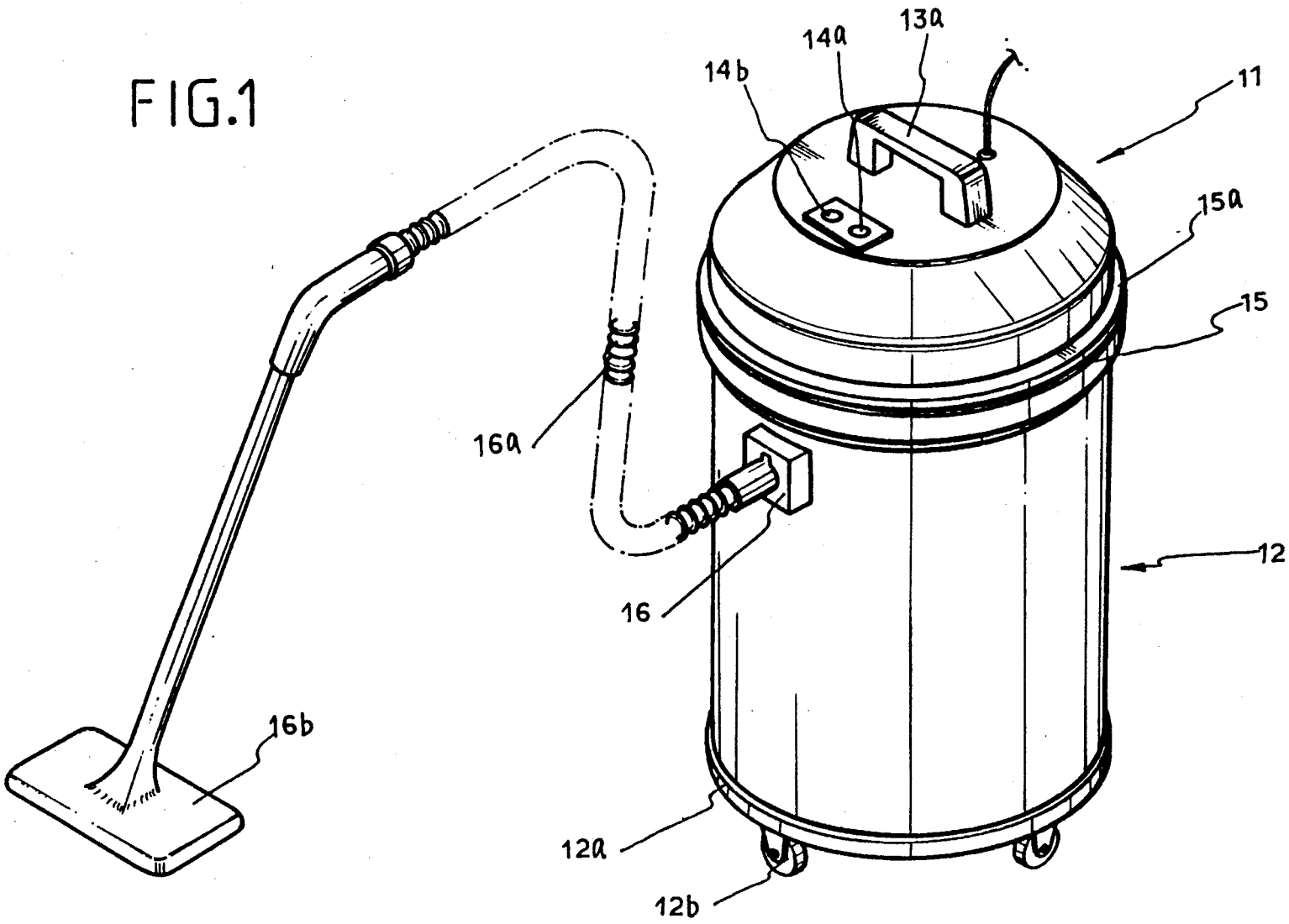
FIG. 1 is a perspective view of the whole assembly of the invention.
Figure 2:
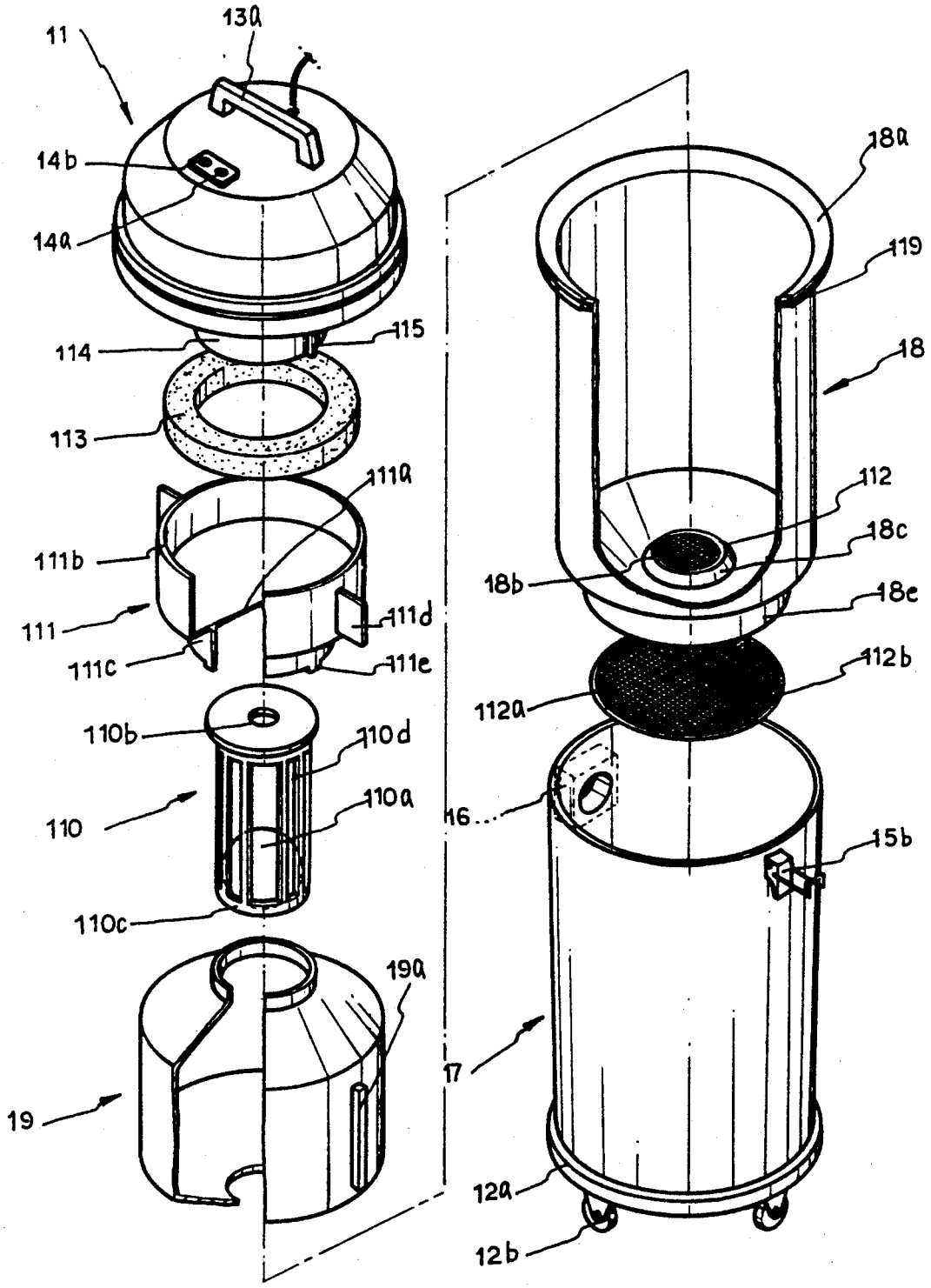
FIG. 2 is an exploded perspective view showing the internal construction of the invention.

Referring now to the figures of the drawings, a no filter type, liquid filtering vacuum cleaner of the invention is disclosed. The vacuum cleaner has a main fan body and a filtering unit. The main fan body 11 is provided with a moter fan chamber G. A casing 13 of main fan body 11 is provided with a carrying handle 13*a*, switch (push-on) 14*a*, switch (push-off) 14*b* on the upper outer surface, and a joint jaw 15*a*. Exhaust openings 15 are formed at the side and bottom of the casing 13.

A filtering unit 12 is provided with a suction hole 16 which can be joined with a flexible hose 16*a* at its upper region, and a number of joint hook 15*b* for the fan body 11, are disposed about it.

A frame 12*a* supports the water tank 17 of the filtering unit 12 and has casters 12*b* for moving it.

The filtering unit 12 comprises the filtering water tank 17, separating middle tub 18, separate inner tub 19, float guide 110 and upper cap 111.

A net frame 112*b* and fabric net 112 are mounted between the said middle tub 18 and water tank 17.

An absorption pad ring 113 is mounted on the upper cap 111.

A pressure sensor 115 for actuating switch 14*c* and a solenoid 118 for actuating switch 14*d* are provided at the lower end of main fan body 11.

The filtering water tank 17 of filtering unit 12 is a container for the liquid, provided with suction hole 16 and a number of joint hooks 15*b* at the side wall, and two annular ribs 17*a*, 17*b* formed on the inner bottom therof, in concentric circles.

The outer annular rib 17*b* has a number of comparatively large holes 17*c* at the upper end.

The holes 17*c* cut off the largest particles of dust from the in-let dust.

A separating middle tub 18 has a flange 18*a* at the upper end and rubber packing 119 for engaging to the upper end of filtering water tank 17. The bottom of the separating middle tub 18 has a concave shaped bottom with a center hole 18*b*. Around the center hole 18*b* there is provided an upper rib 18*c* engaging a net 112*a* to cut the bubbles, a lower end rib 18*d* which extends to the lower side, and a downward rib 18*e* having a stage step 18*f* which engages the net 112*a* at the inner side, concentrically, thereof.

A separating inner tub 19 is provided with a concave shaped top and a center, through hole extends from top to bottom. A float guide 110 is seated on the upper end, and the bottom is joined with the contour of upper rib 18*c* of the separating middle tub 18.

A center chamber B of separating inner tub 19 is a broad space for collecting the in-let liquid from the suppressed rising stream of the liquid because of the flow drawn in accordance with Bernoulli's theorem.

A number of spaced ribs 19*a* protrude from the outside wall of separating inner tub 19 for providing a fixed recovery space 19b and engaging the separating middle tub 18.

A float 110a is provided at the inside of float guide 110 which is seated on the upper end of inner tub 19; and actuated to close off the over flow hole 110b when it is filled with the suctioned liquid. The float guide 110 is provided with a cut open wall and a closed bottom 110c. The water drops from center hole 18b fly in all directions.

An upper cap 111 which controls the air flow is provided with a center partition plate 111a for separating its upper part and lower part.

The outer surface of upper rib 111b is provided with a number of projecting holders 111d for engaging the separating middle tub 18. A lower rib 111c and spaced projections 111e are formed on the bottom of the partition plate 111a.

An absorption pad ring 113 is mounted on the upper inside of partition plate 111a.

A pressure sensor 115 and switch 14c are mounted on the fan cover 114 of the main fan body 11.

Figure 4:
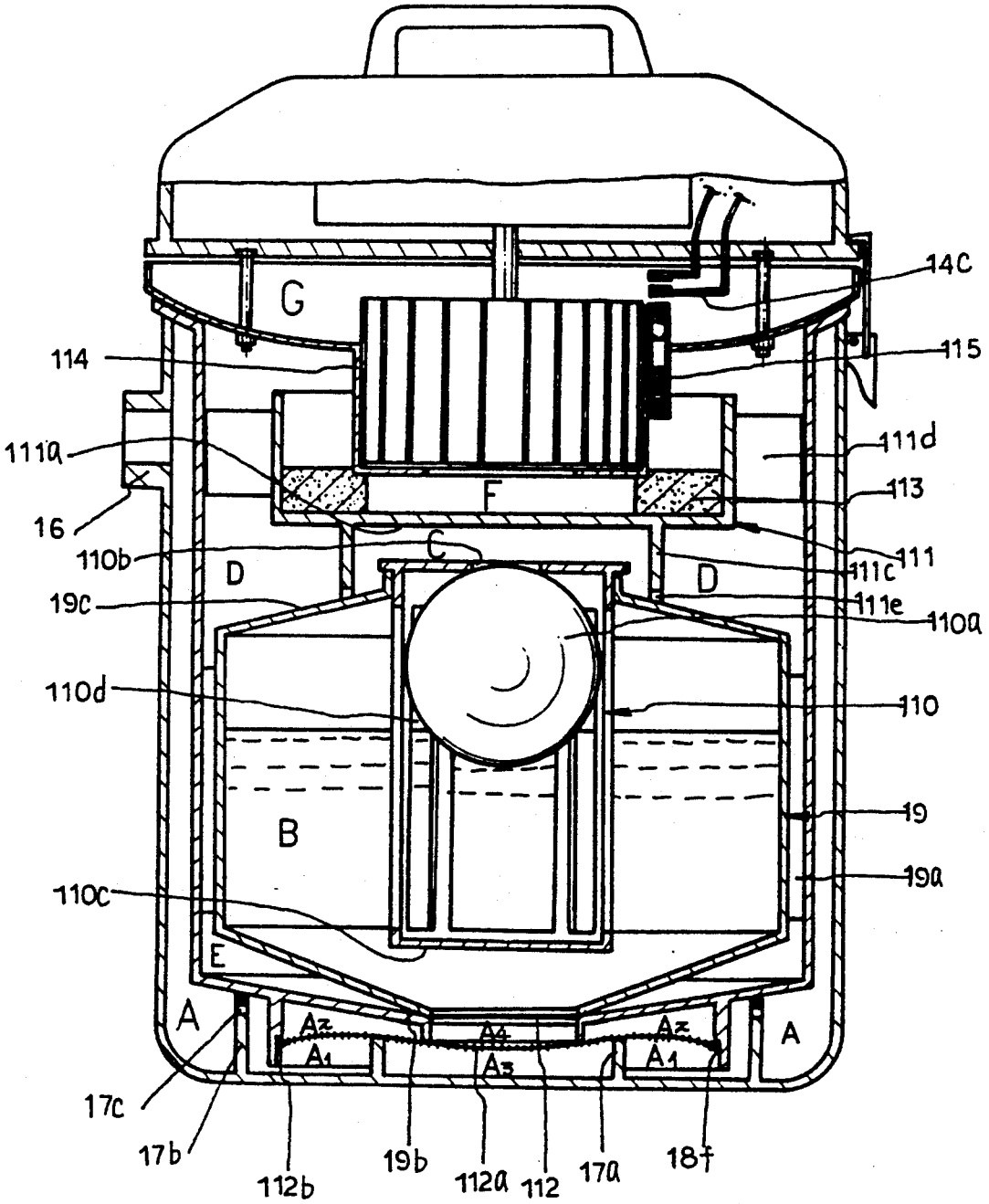
FIG. 4 is a sectional view of the invention in a state of full water level, during operation in the water sweeper mode of the invention.

The electric vacuum cleaner of the invention has a number of chambers A, A1, A2, A3, A4, B, C, D, E, F and G as shown in FIG. 4.

Figure 3:
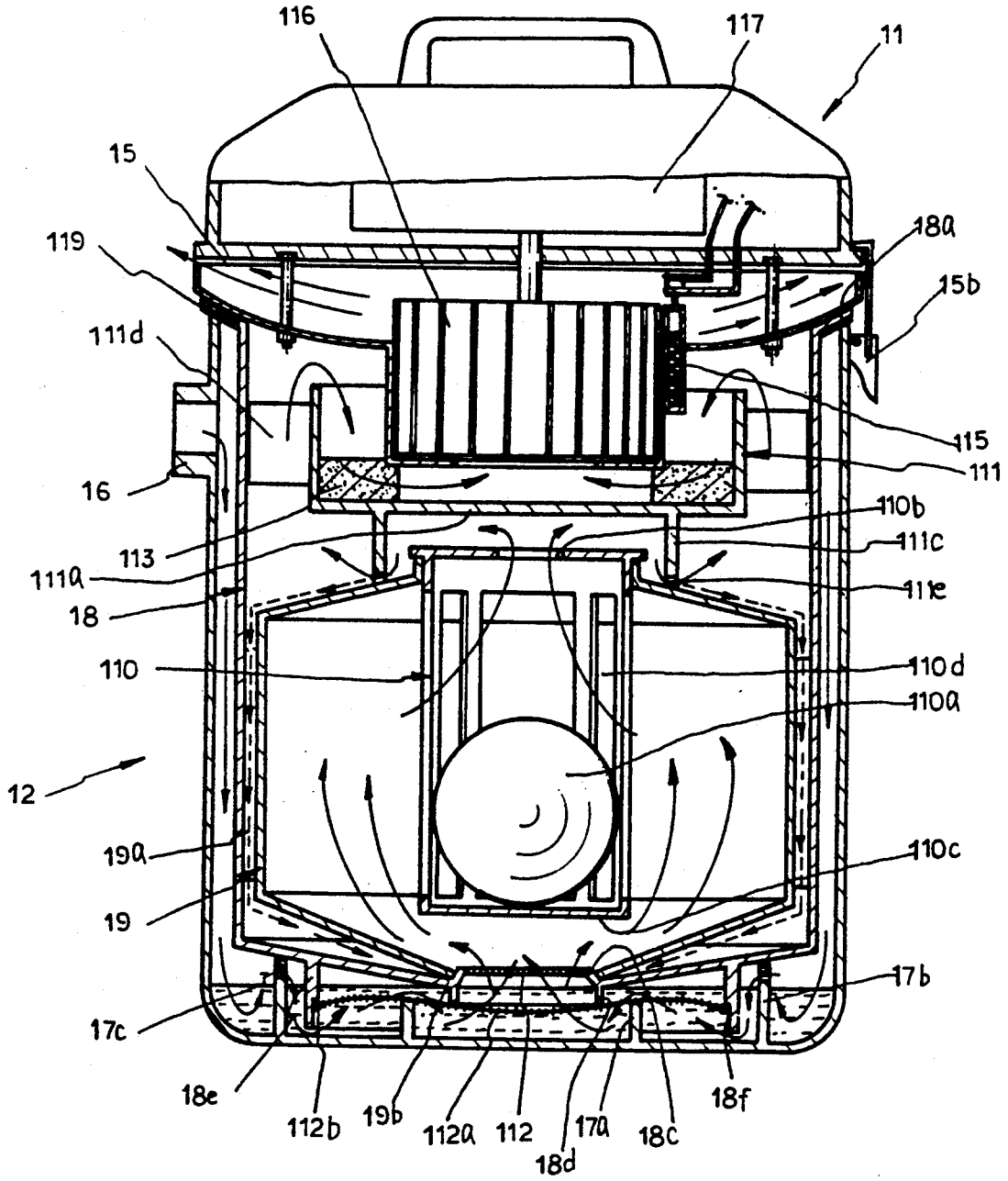
FIG. 3 is a sectional view of the invention in the normal operating mode.

The operation of the invention is described hereinafter;

In FIG. 3, the air flow, with dust and dirt flake which are introduced through the suction hole 16 run against the outer wall of separating middle tub 18 and downward to whirl in chamber A formed by outside annular rib 17b in the water tank 17.

Then the large particles are collected in room A. Air and small particles of dust that flow through the hole 17c of upper end at the outside annular rib 17b under downward rib 18e of the bottom end of separating middle tub 18, are introduced with liquid to chamber A1, pass through net 112a to chambers A2, A3, and A4. By this time, micro dust in the air has been collected completely, as a result of mixing with liquid in the multiple chambers.

Then, the stream is passed through the net cloth 112 which is mounted on the upper side of center hole 18b of the middle tub 18 and introduced into inner tub 19 after the bubbles have dissipated.

Since, the bottom 110c of float guide 110 which installed in the inner tub 19 is closed, the splash water drops go in to all directions, and then flow down.

Since, the middle portion of the inner tub 19 is formed with a large chamber B, the flow rate is lowered in accordance with the Bernoulli's theorem. Thus liquid which has a larger density than air flows down while there is a rising of gas. Only the air travels upward. In these steps, dust is filtered completely and remains with the liquid.

The air rising upward passes through the side wall openings 110d of the float guide 110 and then passes through the overflow hole 110b of the upper end of float guide 110 to chamber C with an elevated flow rate. Then the direction of stream is changed by running it against the partition plate 111a after which it is then returned to downward flow along lower rib 111c.

While the gaseous flow goes through the spaces between spacer projection 111e of lower rib 111c of upper cap 111, the ascending liquid having a larger density than the air, runs against the outer surface of the separating inner tub 19, is then condensed by centrifugal force from the high flow rate and rapid change of flow direction, follows the sloping surface 19c to chamber E as shown by the dotted line of FIG. 3. At the bottom of chamber E, at the junction of middle tub 18 and inner tub 19 there is a small space to which forms a recovery opening 19b.

The recovery opening 19b allows flow through the comparativery small center hole 18b acting as a Venturi tube because of the lowered partial pressure accompanied by a high flow rate. Thus the collected liquid in chamber E is recovered easily.

The air introduced into chamber D travels upwardy via room F and fan 116 to chamber G and is then discharged through exhaust openings 15.

An absorption ring pad 113 is provided in chamber F, upper end of the upper cap 111 for absorbing the micro moisture.

In operation as a water sweeper, refering to the FIG. 4; a float 110a of low density materials provided in float guide 110 which is mounted on separate inner tub 19, is floated upwardly by the level of suctioned water, and then closes off the overflow hole 110b when full water level is reached.

Thus, a large pressure differential is developed between the chamber F and chamber G, at the boundary of fan cover 114 because of the pressure in the chambers C, D, and F is lowered suddenly when the overflow hole 110b is closed.

Then, the switch 14c is opened (turn off) by the pressure sensor 115 which is located on the fan cover 114. Thus the electric source is disconnected and the water suction is stopped.

Figure 5:
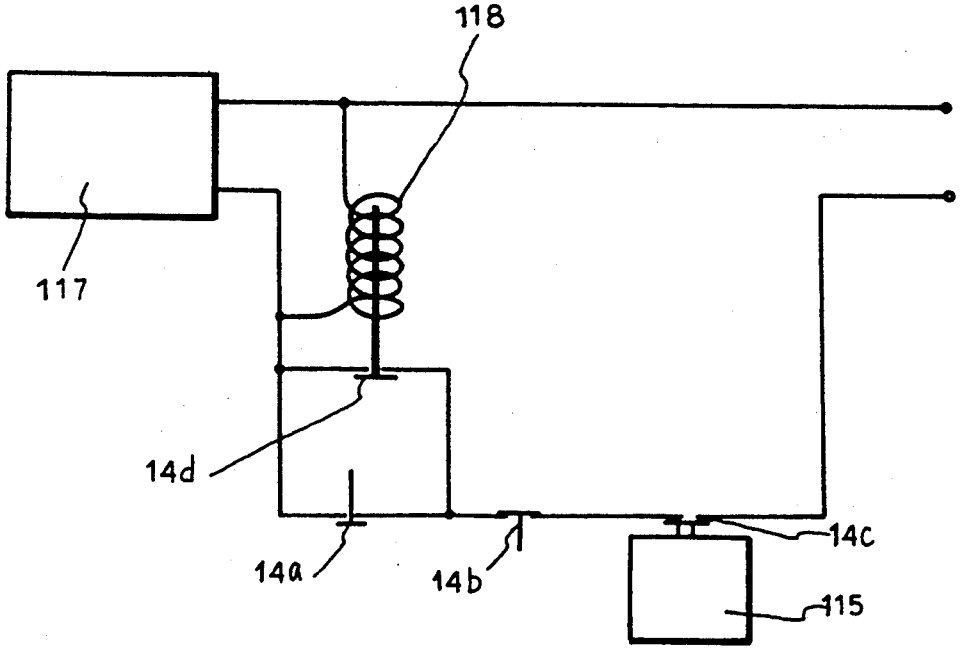
FIG. 5 is the electric circuit of the invention.
Figure 6A:
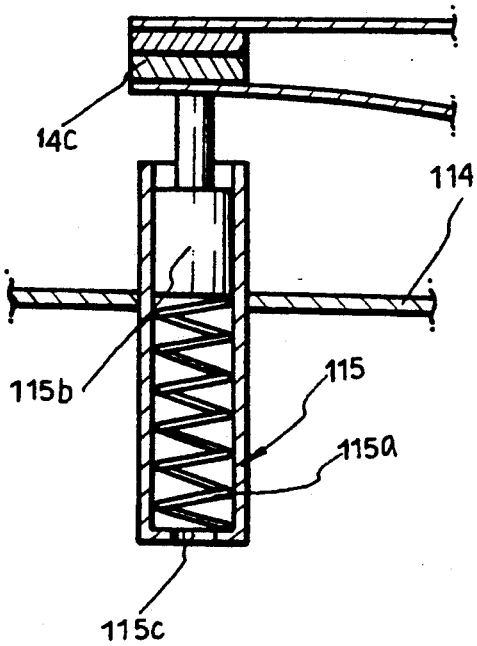
FIG. 6(*a*) is a sectional view showing the closed state (switch on) of the pressure sensor and switch in a normal actuating mode.
Figure 6B:
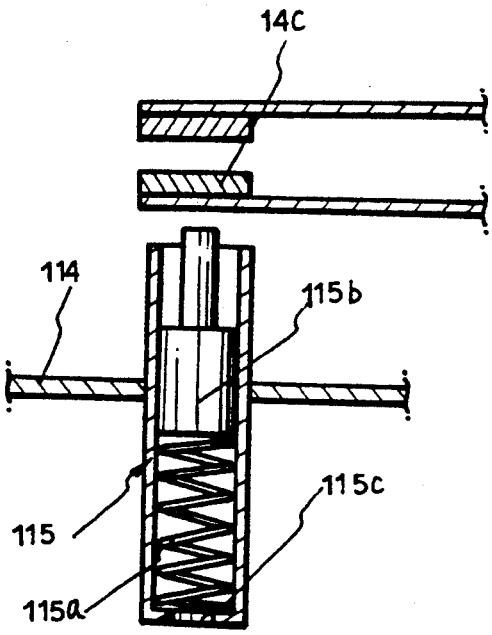

In FIG. 5, a motor 117 and three switches 14a, 14b, and 14c are connected in series. Switch 14d which is actuated by solenoid 118, which is connected in parallel with motor 117, is connected in parallel with switch 14a.

Said switch 14c is a push-on switch. Switch 14c is maintained ON by the pushing of piston 115b by the spring 115a in the pressure sensor 115 in normal mode.

The pressure sensor 115, with an air through hole, is capable of actuation by pressure differential, easily.

In operation for cleaning up water, said over flow hole 110b closed by float 111a upon full water level, the piston 115b is pulled down by the pressure differential between the chamber and chamber G, and the switch 14c is opened.

The switch 14b is a push OFF switch remaining in a closed state in normal mode. It serves to disconnect the electric source when it is desired to stop the operation or the work is completed.

The switch 14d is a push ON switch which is maintained in an open state in normal (stop) mode. It is turned to the ON state by solenoid 118 when the circuit is turned ON.

Thus, if the electric circuit according to the invention is opened, the circuit of solenoid 118, is turned off. It can then be operated only, by turning the start switch 14a ON.

That is, if water is suctioned over the full water level by the water sweeper means, the overflow hole 110b is closed off by the float 110a.

If the switch 14c is cut off by the pressure differential, the motor 117 and fan 116 are stopped.

After a while, the pressures of chamber F and chamber G returns to equality, then the switch 14c is turned ON by the pressure sensor 115. But the over all circuit cannot turn ON, because the solenoid 118 is not yet operating, and switch 14d is opened (OFF).

Figure 7:
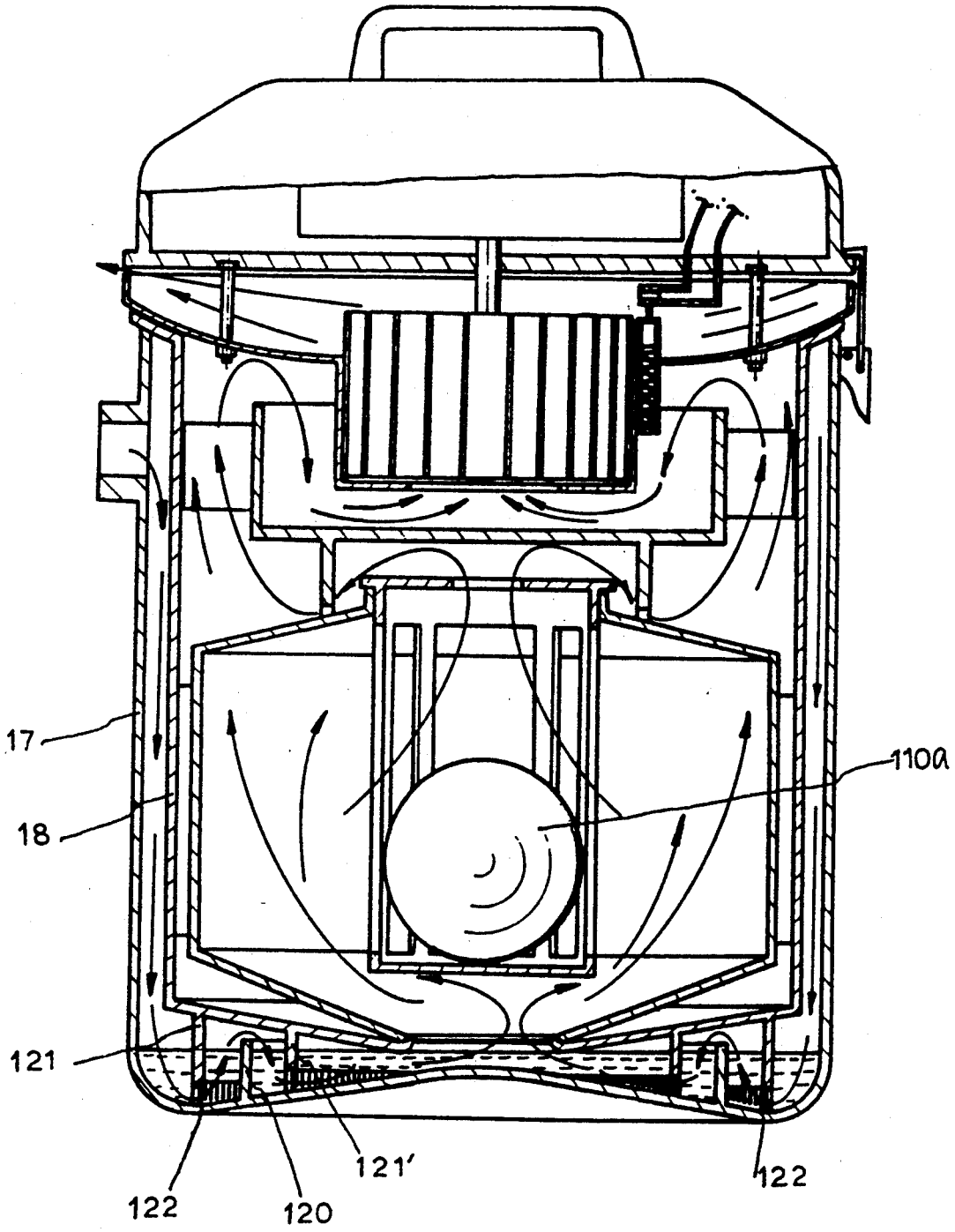
FIG. 7 is a sectional view of another embodiment of the filtering part of the invention.

The other preferred embodiment according to the invention is described in FIG. 7.

The filtering water tank 17 has a convex shaped center inner bottom and a circular rib 120.

The separating middle tub 18 has two downward ribs 121, 121' on the bottom. Said two downward ribs 121, 121' are in engagement with brushes 122.

The said brushes 122 have the effect of increasing contact between the air and water, and can be serviced after use.

The no filter type, liquid filtering vacuum cleaner according to the present invention has the following advantages:

The dust in air and sharp foreign materials are electrostatically charged by friction on passing through the length of flexible hose, whereby electric attraction occurs between dust and water, as a result of the electric polarity of the molecular structure of water. Thus, the microscopic dust can be filtered easily.

The cleansing of the filter tank after use is very simple and sanitary and is accomplished by separating and emptying the tank.

It is no problem for sharp material or glass or water in the in-let.

The vacuum cleaner according to the invention is a water cleaner capable of suctioning a large quantity of water. It has an automatic control means to limit water level.

I claim:

1. A vacuum cleaner comprising:

an outer tank (17) having a suction opening (16) through which air and liquid can enter the tank, means defining within the tank a lower chamber (B), an intermediate chamber (F), and an upper chamber (G)

an air outlet opening in the upper chamber, a fan (116) between the intermediate and upper chambers for drawing air, which enters the outer tank through the suction opening, through the lower and intermediate chambers and into the upper chamber, the air leaving the upper chamber through the outlet opening, an electrical circuit including a motor (117) for operating the fan, an overflow hole (**110*b*) at the upper end of the lower chamber through which the lower and intermediate chambers communicate, passageway means through which liquid entering the outer tank through the suction opening can enter and fill the lower chamber, a float (110*a***) within the lower chamber for closing the overflow hole when the liquid in the lower chamber reaches a predetermined level, closing of the overflow hole closing off the flow of air to the intermediate chamber and hence producing an air pressure differential between the intermediate and upper chambers, and means responsive to that pressure differential for opening the electrical circuit and deenergizing the fan motor.

2. A vacuum cleaner comprising:

an outer tank having a suction opening through which air containing dust can enter the tank, means defining within the tank a lower chamber, an intermediate chamber and an upper chamber, an air outlet opening in the upper chamber, a fan between the intermediate and upper chambers for drawing air, which enters the outer tank through the suction opening, through the lower chamber, through the intermediate chamber and into the upper chamber, the air leaving the upper chamber through the outlet opening, an electrical circuit including a motor for operating the fan, an opening at the upper end of the lower chamber through which the lower and intermediate chambers communicate, at least one divider means extending from the tank into said lower chamber for partially subdividing said lower chamber into a plurality of subchambers in fluid communication, wherein said divider means comprises first and second concentrically spaced annular ribs, the first rib depending downwardly from the exterior of said intermediate chamber into said lower chamber and the second annular rib extending upwardly from the bottom interior of said lower chamber, a liquid medium disposed in said lower chamber, and passageway means through which said air and dust entering the outer tank through the suction opening can enter the lower chamber for passing through the liquid medium in the subchambers, whereby dust is transferred from the air to the liquid medium.

3. A vacuum cleaner comprising:

an outer tank having a suction opening through which air containing dust can enter the tank, means defining within the tank a lower chamber, an intermediate chamber and an upper chamber, an air outlet opening in the upper chamber, a fan between the intermediate and upper chambers for drawing air, which enters the outer tank through the suction opening, through the lower chamber, through the intermediate chamber and into the upper chamber, the air leaving the upper chamber through the outlet opening, an electrical circuit including a motor for operating the fan, an opening at the upper end of the lower chamber through which the lower and intermediate chambers communicate, at least one divider means extending from the tank into said lower chamber for partially subdividing said lower chamber into a plurality of subchambers in fluid communication, wherein said divider means comprises an annular rib depending downwardly from the exterior of said intermediate chamber means into said lower chamber and the bottom of the outer tank is convex, and further comprising brush means mounted on said divider means.

4. A vacuum cleaner according to claim 2 where the outermost rib is apertured to enable fluid communication between the subchambers it divides.

* * * * *